US011279132B2

(12) United States Patent
Hagiwara et al.

(10) Patent No.: US 11,279,132 B2
(45) Date of Patent: Mar. 22, 2022

(54) LIQUID EJECTING APPARATUS

(71) Applicant: SEIKO EPSON CORPORATION, Tokyo (JP)

(72) Inventors: Hiroyuki Hagiwara, Matsumoto (JP); Hajime Nakao, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/004,279

(22) Filed: Aug. 27, 2020

(65) Prior Publication Data

US 2021/0060940 A1 Mar. 4, 2021

(30) Foreign Application Priority Data

Aug. 29, 2019 (JP) ..... JP2019-156757

(51) Int. Cl.
*B41J 2/145* (2006.01)

(52) U.S. Cl.
CPC ..... *B41J 2/145* (2013.01)

(58) Field of Classification Search
CPC ..... B41J 2/145
See application file for complete search history.

(56) References Cited

U.S. PATENT DOCUMENTS 7,407,263 B2 * 8/2008 Kawase ..... B41J 2/2103 347/40
2017/0291417 A1 10/2017 Okubo et al.

FOREIGN PATENT DOCUMENTS

JP 2017-189897 A 10/2017

* cited by examiner

*Primary Examiner* — Lamson D Nguyen
(74) *Attorney, Agent, or Firm* — Workman Nydegger

(57) ABSTRACT

A liquid ejecting apparatus includes a first head unit having a first head provided with a plurality of first nozzles and a second head unit having a second head provided with a plurality of second nozzles and a third head provided at a position different from the second head in a first direction and provided with a plurality of third nozzles. The second head and the third head are provided at different positions in a second direction intersecting with the first direction, and the first head unit and the second head unit are disposed such that a width at which the first head and the second head overlap in the first direction is smaller than a width at which the second head and the third head overlap in the first direction.

17 Claims, 8 Drawing Sheets

LIQUID EJECTING APPARATUS

The present application is based on, and claims priority from JP Application Serial Number 2019-156757, filed Aug. 29, 2019, the disclosure of which is hereby incorporated by reference herein in its entirety.

BACKGROUND

1. Technical Field

The present disclosure relates to a liquid ejecting apparatus.

2. Related Art

In the related art, a liquid ejecting apparatus including a plurality of heads ejecting a liquid such as ink with respect to a medium such as printing paper has been proposed. The liquid ejecting apparatus described in JP-A-2017-189897 includes a plurality of head units having a plurality of heads. In the liquid ejecting apparatus, the plurality of head units are disposed along a straight line shape in one direction while the heads of the head units that are adjacent to each other are partially overlapped in one direction. A head unit group elongated in one direction is configured by the plurality of head units being arranged in parallel in the straight line shape. In addition, in each head unit, the plurality of heads are disposed along one direction while the adjacent heads are partially overlapped in one direction.

SUMMARY

By partially overlapping the adjacent heads, it is possible to suppress a decline in image quality resulting from the concentration difference between the heads. However, an unnecessary increase in the width at which the heads overlap leads to a decline in throughput.

In order to solve the above problems, a liquid ejecting apparatus according to a preferred aspect of the present disclosure, which is a liquid ejecting apparatus ejecting a liquid, includes a first head unit having a first head provided with a plurality of first nozzles and a second head unit having a second head provided with a plurality of second nozzles and a third head provided at a position different from the second head in a first direction and provided with a plurality of third nozzles. The second head and the third head are provided at different positions in a second direction intersecting with the first direction, and the first head unit and the second head unit are disposed such that a width at which the first head and the second head overlap in the first direction is smaller than a width at which the second head and the third head overlap in the first direction.

In addition, a liquid ejecting apparatus according to a preferred aspect of the present disclosure, which is a liquid ejecting apparatus ejecting a liquid, includes a first head unit having a first head provided with a plurality of first nozzles and a second head unit having a second head provided with a plurality of second nozzles and a third head provided at a position different from the second head in a first direction and provided with a plurality of third nozzles. The second head and the third head of the second head unit are provided at different positions in a second direction intersecting with the first direction, and the first head unit and the second head unit are disposed such that a width at which a first nozzle row having the plurality of first nozzles and a second nozzle row having the plurality of second nozzles overlap in the first direction is smaller than a width at which the second nozzle row and a third nozzle row having the plurality of third nozzles overlap in the first direction.

DESCRIPTION OF EXEMPLARY EMBODIMENTS

Mutually orthogonal X, Y, and Z axes are assumed in the following description. As exemplified in FIG. 2, one direction along the X axis as viewed from any point is referred to as an X1 direction and the direction that is opposite to the X1 direction is referred to as an X2 direction. Likewise, directions opposite to each other along the Y axis from any point are referred to as Y1 and Y2 directions and directions opposite to each other along the Z axis from any point are referred to as Z1 and Z2 directions. An X-Y plane including the X axis and the Y axis corresponds to a horizontal plane. The Z axis is an axis along a vertical direction, and the Z2 direction corresponds to the lower side in the vertical direction. It should be noted that the X axis, the Y axis, and the Z axis may mutually intersect at an angle of substantially 90 degrees. In addition, the dimension and scale of each portion in the accompanying drawings are appropriately different from the actual ones and some parts are schematically illustrated so that understanding is facilitated.

In addition, the Y1 direction corresponds to a "first direction" in the following description. In this case, the X1 direction intersecting with the Y1 direction corresponds to a "second direction". In the present embodiment, the Y1 direction and the X1 direction are orthogonal to each other. One side and the other side respectively correspond to a "first side" and a "second side" with respect to any point along an axis along the Y1 direction. Hereinafter, the "first side in the Y1 direction" corresponds to the Y1 direction. The "second side opposite to the first side in the Y1 direction" corresponds to the Y2 direction. In addition, one side and the other side respectively correspond to a "third side" and a "fourth side" with respect to any point along an axis along the X1 direction. Hereinafter, the "third side in the X1 direction" corresponds to the X2 direction. The "fourth side opposite to the third side in the X2 direction" corresponds to the X1 direction.

1. First Embodiment

1-1. Overall Configuration of Liquid Ejecting Apparatus 100

Figure 1:
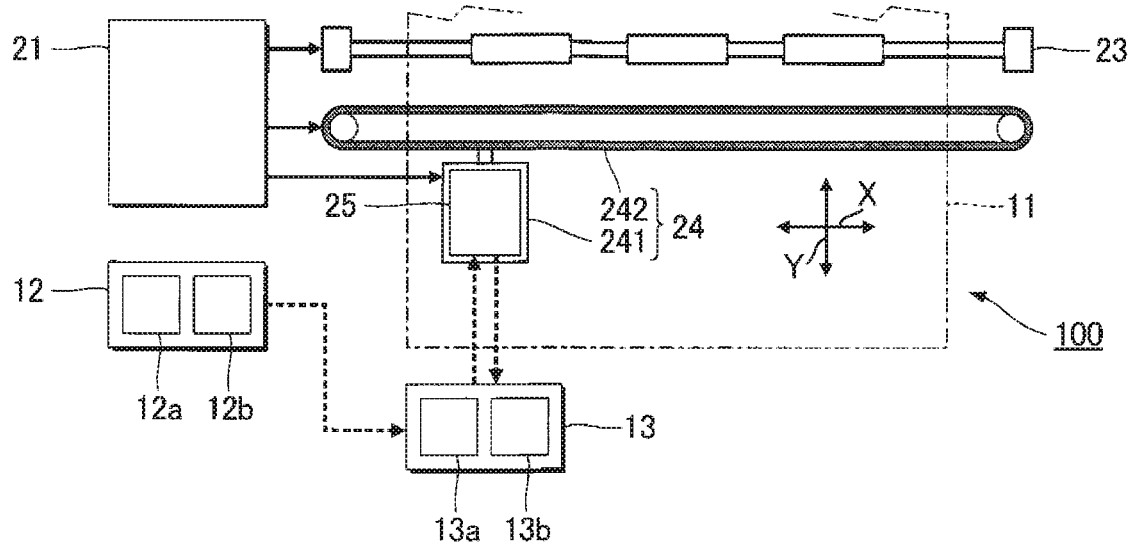
FIG. 1 is a block diagram exemplifying the configuration of a liquid ejecting apparatus in a first embodiment.

FIG. 1 is a configuration diagram of the liquid ejecting apparatus 100 in a first embodiment. The liquid ejecting apparatus 100 is an ink jet printing apparatus ejecting ink, which is an example of a liquid, as droplets to a medium 11. Typically, the medium 11 is printing paper. However, a printing object of any material such as a resin film and a cloth is used as the medium 11.

As exemplified in FIG. 1, a liquid container 12 storing ink is installed in the liquid ejecting apparatus 100. For example, a cartridge that can be attached to and detached from the liquid ejecting apparatus 100, a bag-shaped ink pack that is formed of a flexible film, or an ink tank that can be replenished with ink is used as the liquid container 12. As exemplified in FIG. 1, the liquid container 12 includes a first liquid container 12*a* and a second liquid container 12*b*. First ink is stored in the first liquid container 12*a*, and second ink is stored in the second liquid container 12*b*. The first ink and the second ink are different types of ink. As one example of the first ink and the second ink, the first ink may be cyan ink and the second ink may be magenta ink.

The liquid ejecting apparatus 100 is provided with a sub tank 13 temporarily storing ink. Ink supplied from the liquid container 12 is stored in the sub tank 13. The sub tank 13 includes a first sub tank 13*a* in which the first ink is stored and a second sub tank 13*b* in which the second ink is stored. The first sub tank 13*a* is coupled to the first liquid container 12*a*, and the second sub tank 13*b* is coupled to the second liquid container 12*b*. In addition, the sub tank 13 is coupled to a head module 25, supplies ink to the head module 25, and collects ink from the head module 25. The ink flow between the sub tank 13 and the head module 25 will be described in detail later.

As exemplified in FIG. 1, the liquid ejecting apparatus 100 includes a control unit 21, a transport mechanism 23, a moving mechanism 24, and the head module 25. The control unit 21 controls each element of the liquid ejecting apparatus 100. The control unit 21 includes, for example, one or a plurality of processing circuits such as a central processing unit (CPU) and a field programmable gate array (FPGA) and one or a plurality of storage circuits such as a semiconductor memory.

The transport mechanism 23 transports the medium 11 along the Y axis under the control of the control unit 21. The moving mechanism 24 causes the head module 25 to reciprocate along the X axis under the control of the control unit 21. The moving mechanism 24 of the present embodiment includes a substantially box-type transport body 241 accommodating the head module 25 and an endless belt 242 to which the transport body 241 is fixed. It should be noted that a configuration in which the transport body 241 is equipped with the liquid container 12, the sub tank 13, and the head module 25 can also be adopted.

The head module 25 ejects ink supplied from the sub tank 13 from each of a plurality of nozzles to the medium 11 under the control of the control unit 21. An image is formed on the surface of the medium 11 by the head module 25 ejecting ink to the medium 11 in parallel with the transport of the medium 11 by the transport mechanism 23 and the repetitive reciprocation of the transport body 241. It should be noted that ink not ejected from the plurality of nozzles is discharged to the sub tank 13.

It should be noted that the sub tank 13 in the present embodiment constitutes a part of an external flow path portion (not illustrated) installed outside the head module 25. The external flow path portion includes a flow path coupling the head module 25 and the sub tank 13, a circulation pump for sending ink from the head module 25 to the sub tank 13, and the like.

1-2. Overall Configuration of Head Module 25

Figure 2:
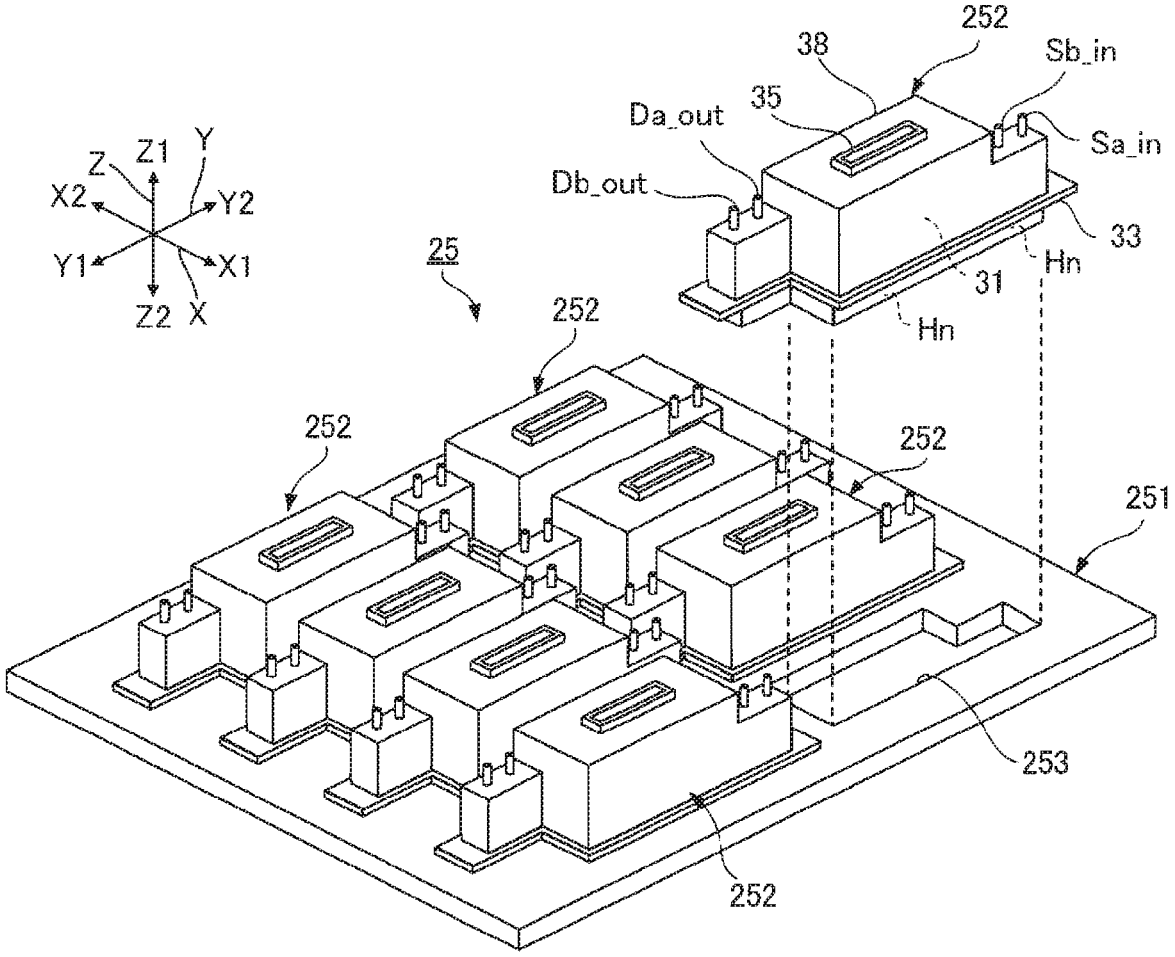
FIG. 2 is a perspective view of a head module.

FIG. 2 is a perspective view of the head module 25. As exemplified in FIG. 2, the head module 25 includes a support body 251 and a plurality of head units 252. The support body 251 is a plate-shaped member supporting the plurality of head units 252. A plurality of attachment holes 253 are formed in the support body 251. Each head unit 252 is supported by the support body 251 in a state of being inserted in the attachment hole 253. The plurality of head units 252 are arranged in a matrix along the X axis and the Y axis. However, the number of the head units 252 and the aspect of arrangement of the plurality of head units 252 are not limited to the above exemplification. For example, three or more head units 252 may be disposed side by side along the Y1 direction.

1-3. Overall Configuration of Head Unit 252

Figure 3:
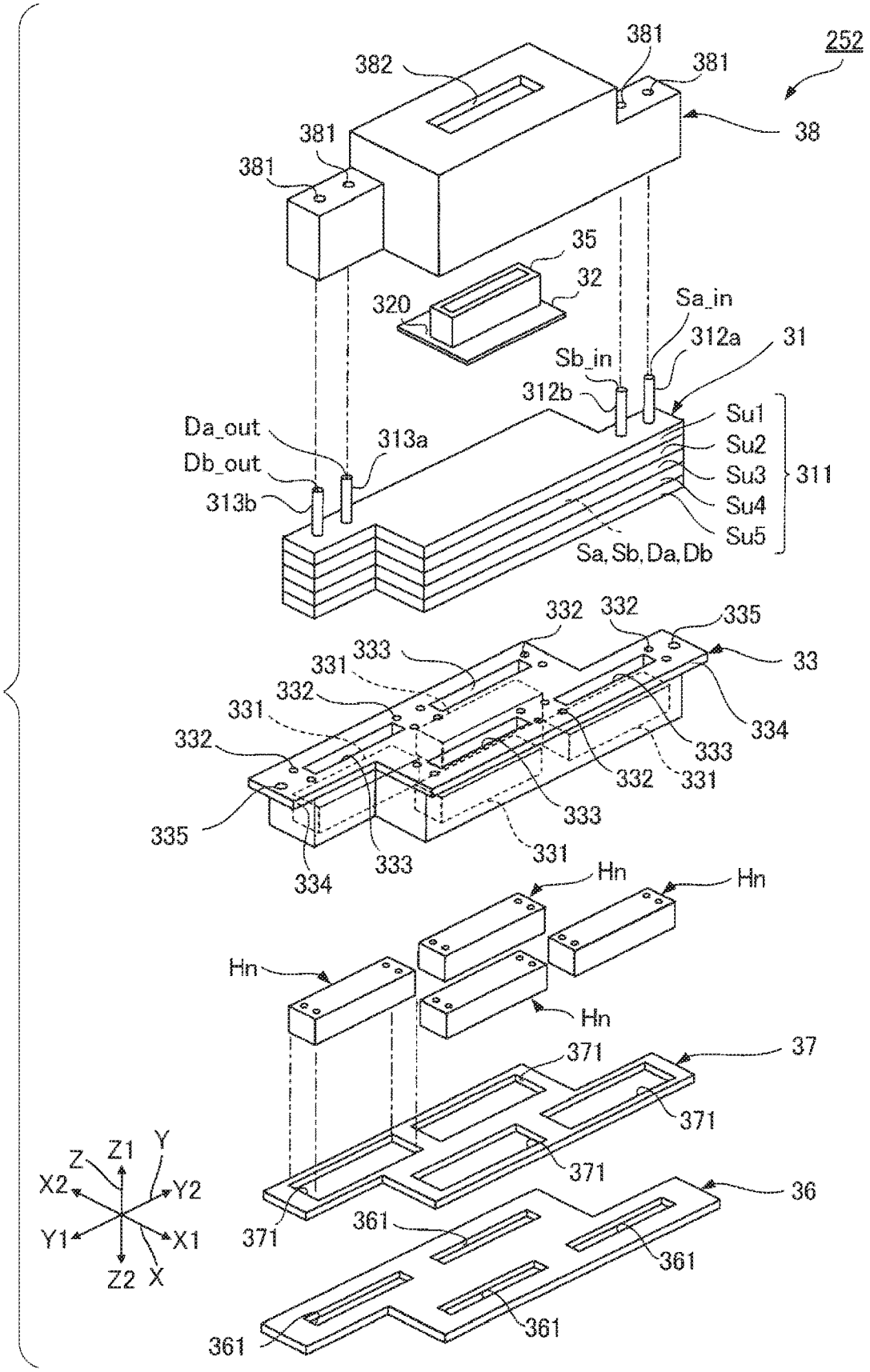
FIG. 3 is an exploded perspective view of a head unit.

FIG. 3 is an exploded perspective view of the head unit 252. As exemplified in FIG. 3, the head unit 252 includes a flow path member 31, a wiring substrate 32, a holder 33, a plurality of circulation heads Hn, a fixing plate 36, a reinforcing plate 37, and a cover 38. The flow path member 31 is positioned between the wiring substrate 32 and the holder 33.

The flow path member 31 is a member in which a flow path through which ink flows is formed. The flow path member 31 includes a flow path structure 311, a first supply protruding portion 312*a*, a second supply protruding portion 312*b*, a first discharge protruding portion 313*a*, and a second discharge protruding portion 313*b*.

The flow path structure 311 is configured by stacking of a substrate Su1, a substrate Su2, a substrate Su3, a substrate Su4, and a substrate Su5. The substrate Su1 is positioned on the uppermost layer in the vertical direction, and the substrate Su5 is positioned on the lowermost layer in the vertical direction. The plurality of substrates Su1, Su2, Su3, Su4, and Su5 are formed by, for example, injection molding of a resin material and are mutually bonded by an adhesive. It should be noted that the substrates Su1, Su2, Su3, Su4, and Su5 will be referred to as substrates Su in the following description when the substrates Su1, Su2, Su3, Su4, and Su5 are not distinguished.

A first supply flow path Sa, a second supply flow path Sb, a first discharge flow path Da, and a second discharge flow path Db are provided in the flow path structure 311. The first supply flow path Sa is a flow path for supplying the first ink stored in the first sub tank 13*a* illustrated in FIG. 1 to the plurality of circulation heads Hn. The second supply flow path Sb is a flow path for supplying the second ink stored in the second sub tank 13*b* illustrated in FIG. 1 to the plurality of circulation heads Hn. The first discharge flow path Da is a flow path for discharging the first ink not ejected from the plurality of circulation heads Hn to the first sub tank 13*a*. The second discharge flow path Db is a flow path for discharging the second ink not ejected from the plurality of circulation heads Hn to the second sub tank 13*b*. Each of the first supply flow path Sa, the second supply flow path Sb, the first discharge flow path Da, and the second discharge flow path Db is a space formed in the flow path structure 311. The space is formed by one or both of grooves along the X-Y plane respectively provided in the two substrates Su that are adjacent to each other.

As exemplified in FIG. 3, each of the first supply protruding portion 312*a*, the second supply protruding portion 312*b*, the first discharge protruding portion 313*a*, and the second discharge protruding portion 313*b* protrudes in the Z1 direction from the flow path structure 311. The first supply protruding portion 312*a* is a supply pipe provided with a first supply port Sa_in for supplying the first ink from the first sub tank 13*a* to the first supply flow path Sa. The second supply protruding portion 312*b* is a supply pipe provided with a second supply port Sb_in for supplying the second ink from the second sub tank 13*b* to the second supply flow path Sb. The first discharge protruding portion 313*a* is a discharge pipe provided with a first discharge port Da_out for discharging the first ink from the first discharge flow path Da to the first sub tank 13*a*. The second discharge protruding portion 313*b* is a discharge pipe provided with a second discharge port Db_out for discharging the second ink from the second sub tank 13*b* to the second discharge flow path Db.

The wiring substrate 32 exemplified in FIG. 3 is a mounting component for electrically coupling the head unit 252 to the control unit 21 exemplified in FIG. 1. The wiring substrate 32 is disposed on the flow path member 31. A connector 35 is installed on the wiring substrate 32. The connector 35 is a coupling component for electrically coupling the head unit 252 and the control unit 21. The wiring substrate 32 has a drive portion 320. The drive portion 320 includes, for example, wiring for supplying a drive signal (COM signal) for driving drive elements Ea and Eb of the circulation head Hn (described later) or a holding signal (VBS signal) for defining a constant reference voltage of the drive elements Ea and Eb to the drive elements Ea and Eb. Although not illustrated, wiring coupled to the plurality of circulation heads Hn is coupled to the wiring substrate 32. It should be noted that the wiring may be configured integrally with the wiring substrate 32.

As exemplified in FIG. 3, the holder 33 is a structure accommodating and supporting a plurality of circulation heads H1, H2, H3, and H4. It should be noted that the circulation heads H1, H2, H3, and H4 will be referred to as the circulation head Hn in the following description when the circulation heads H1, H2, H3, and H4 are not distinguished. A resin material, a metal material, or the like constitutes the holder 33. The holder 33 is provided with a plurality of recess portions 331, a plurality of ink holes 332, and a plurality of wiring holes 333. The circulation head Hn is disposed in each recess portion 331. Each ink hole 332 is a flow path for allowing ink to flow between the flow path member 31 and the circulation head Hn. Each wiring hole 333 is a hole through which wiring (not illustrated) coupling the circulation head Hn and the wiring substrate 32 is passed. In addition, the holder 33 has a flange 334 for fixing the holder 33 to the support body 251 exemplified in FIG. 1. The flange 334 is a fixing portion provided with a plurality of screw holes 335 for screwing with respect to the support body 251.

Each circulation head Hn ejects ink supplied from the flow path member 31. Although not illustrated in FIG. 3, each circulation head Hn has a plurality of nozzles for ejecting the first ink and a plurality of nozzles for ejecting the second ink.

The fixing plate 36 is a plate member for fixing the plurality of circulation heads Hn to the holder 33. Specifically, the fixing plate 36 is disposed in a state where the plurality of circulation heads Hn are pinched between the holder 33 and the fixing plate 36 and is fixed to the holder 33 by an adhesive. A metal material or the like constitutes the fixing plate 36. The fixing plate 36 is provided with a plurality of opening portions 361 for exposing the nozzles of the plurality of circulation heads Hn. In the exemplification of FIG. 3, the plurality of opening portions 361 are individually provided for each circulation head Hn. It should be noted that the opening portion provided in the fixing plate 36 for exposing the nozzle of the circulation head Hn may be shared by two or more circulation heads Hn.

The reinforcing plate 37 is disposed between the holder 33 and the fixing plate 36 and is fixed to the fixing plate 36 by an adhesive. Accordingly, the reinforcing plate 37 reinforces the fixing plate 36. The reinforcing plate 37 is provided with a plurality of opening portions 371 where the plurality of circulation heads Hn are disposed. A metal material or the like constitutes the reinforcing plate 37. From the viewpoint of the reinforcement described above, it is preferable that the reinforcing plate 37 is larger in thickness than the fixing plate 36.

The cover 38 is a box-shaped member accommodating the flow path structure 311 of the flow path member 31 and the wiring substrate 32. A resin material or the like constitutes the cover 38. The cover 38 is provided with four protruding portion holes 381 and an opening portion 382. The first supply protruding portion 312*a*, the second supply protruding portion 312*b*, the first discharge protruding portion 313*a*, or the second discharge protruding portion 313*b* is inserted through each protruding portion hole 381. The connector 35 is inserted through the opening portion 382.

Figure 4:
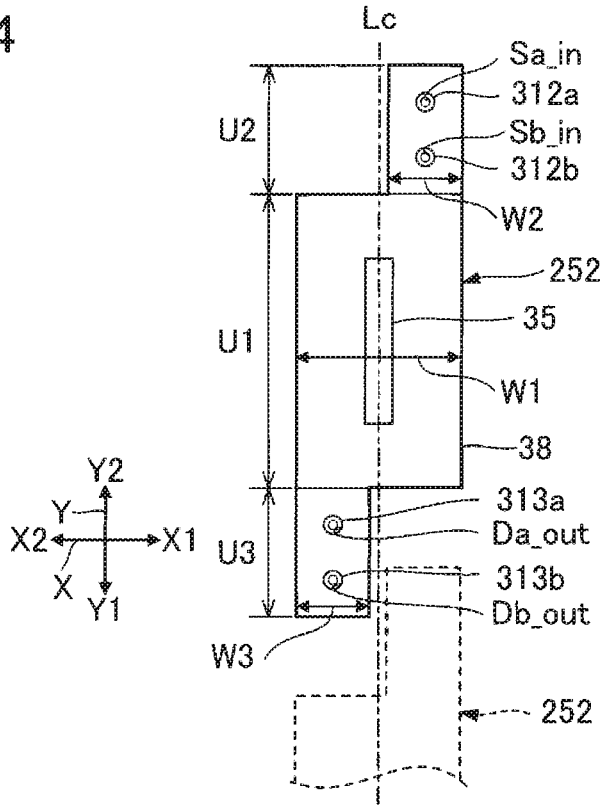
FIG. 4 is a plan view of the head unit.

FIG. 4 is a plan view in which the head unit 252 is viewed from the Z1 direction. As exemplified in FIG. 4, each head unit 252 is configured to have an outer shape including a first head part U1, a second head part U2, and a third head part U3 when viewed from the Z1 direction. Each of the first head part U1, the second head part U2, and the third head part U3 has a quadrangular shape whose longitudinal direction is the Y1 direction when viewed from the Z1 direction. The first head part U1 is positioned between the second head part U2 and the third head part U3. Specifically, the second head part U2 is positioned in the Y2 direction with respect to the first head part U1 and the third head part U3 is positioned in the Y1 direction with respect to the first head part U1.

FIG. 4 illustrates a center line Lc, which is a line segment passing through the center of the first head part U1 along the Y axis. In the present embodiment, the center line Lc is also a line segment passing through the geometric center of the head unit 252 along the Y axis. The second head part U2 is positioned in the X1 direction with respect to the center line Lc, and the third head part U3 is positioned in the X2 direction with respect to the center line Lc. In other words, the second head part U2 and the third head part U3 are positioned on the opposite sides of the X axis across the center line Lc. In addition, the connector 35 is positioned at the first head part U1. The first supply protruding portion 312*a* and the second supply protruding portion 312*b* are positioned at the second head part U2. The first discharge protruding portion 313*a* and the second discharge protruding portion 313*b* are positioned at the third head part U3.

A width W2 of the second head part U2 along the X axis is shorter than a width W1 of the first head part U1 along the X axis. The width W2 is equal to or less than half the width W1. In addition, a width W3 of the third head part U3 along the X axis is shorter than the width W1 of the first head part U1 along the X axis. The width W3 is equal to or less than half the width W1. It should be noted that each of the widths W2 and W3 may be equal to or greater than half of the width W1. In addition, the width W2 and the width W3 are equal to each other in the example illustrated in FIG. 4. It should be noted that the width W2 and the width W3 may be different from each other. However, when the width W2 and the width W3 are equal to each other, it is possible to enhance the symmetry of the shape of the head unit 252 and, as a result, there is an advantage that the plurality of head units 252 are closely arranged with ease. The width W1 of the first head part U1, the width W2 of the second head part U2, and the width W3 of the third head part U3 are the widths between one and the other side end portions of the respective parts along the X axis.

Figure 5:
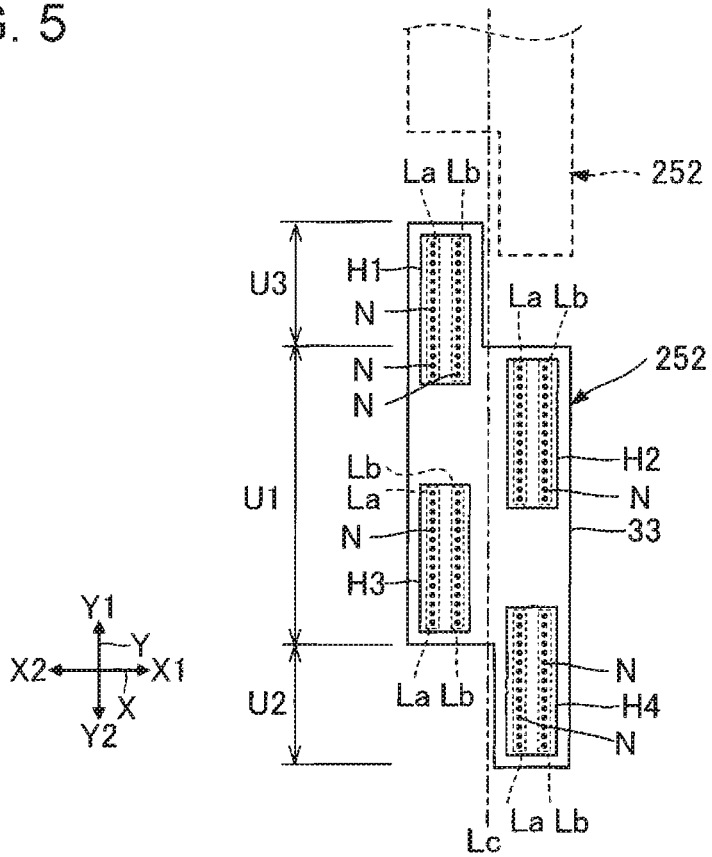
FIG. 5 is a plan view of the head unit.

FIG. 5 is a plan view in which the head unit 252 is viewed from the Z2 direction. It should be noted that the fixing plate 36 and the reinforcing plate 37 are not illustrated in FIG. 5. As exemplified in FIG. 5, the circulation head H1 is disposed across the first head part U1 and the third head part U3. Each of the circulation head H2 and the circulation head H3 is disposed at the first head part U1. The circulation head H4 is disposed across the first head part U1 and the second head part U2. In addition, the circulation head H1 and the circulation head H3 are positioned in the X2 direction with respect to the center line Lc and the circulation head H2 and the circulation head H4 are positioned in the X1 direction with respect to the center line Lc. A part of the circulation head H1 and a part of the circulation head H2 overlap on the Y axis. A part of the circulation head H2 and a part of the circulation head H3 overlap on the Y axis. A part of the circulation head H3 and a part of the circulation head H4 overlap on the Y axis.

A plurality of nozzles N of each of the circulation heads H1, H2, H3, and H4 are divided into a nozzle row La and a nozzle row Lb. Each of the nozzle rows La and Lb is a set of the plurality of nozzles N arranged along the Y axis. The nozzle row La and the nozzle row Lb are provided side by side at an interval in the direction of the X axis. In the following description, subscript a is added to the reference numeral of an element related to the nozzle row La and subscript b is added to the reference numeral of an element related to the nozzle row Lb.

1-4. Circulation Head Hn

Figure 6:
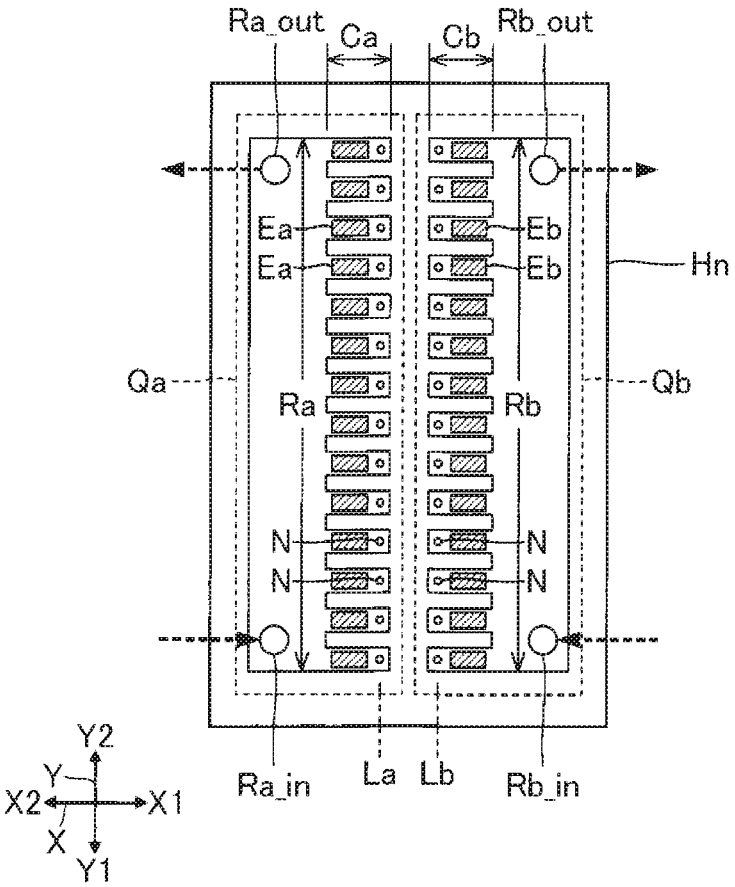
FIG. 6 is a plan view exemplifying the configuration of a circulation head.

FIG. 6 is a plan view exemplifying the configuration of each circulation head Hn. FIG. 6 schematically illustrates the internal structure of the circulation head Hn as viewed from the Z1 direction. As exemplified in FIG. 6, each circulation head Hn includes a first liquid ejecting portion Qa and a second liquid ejecting portion Qb. The first liquid ejecting portion Qa ejects the first ink supplied from the first sub tank 13*a* exemplified in FIG. 1 from each nozzle N of the nozzle row La. The second liquid ejecting portion Qb ejects the second ink supplied from the second sub tank 13*b* from each nozzle N of the nozzle row Lb.

As exemplified in FIG. 6, the first liquid ejecting portion Qa includes a first liquid storage chamber Ra, a plurality of pressure chambers Ca, and a plurality of drive elements Ea. The first liquid storage chamber Ra is a common liquid chamber continuous over the plurality of nozzles N of the nozzle row La. The pressure chamber Ca and the drive element Ea are provided so as to respectively correspond to the nozzle N of the nozzle row La. The pressure chamber Ca is a space communicating with the nozzle N. Each of the plurality of pressure chambers Ca is filled with the first ink supplied from the first liquid storage chamber Ra. The drive element Ea is an energy generation element generating energy for ejecting ink by a drive signal being applied. Specifically, the drive element Ea changes the pressure of the first ink in the pressure chamber Ca. For example, a piezoelectric element changing the volume of the pressure chamber Ca by deforming the wall surface of the pressure chamber Ca or a heating element generating bubbles in the pressure chamber Ca by heating of the first ink in the pressure chamber Ca is preferably used as the drive element Ea. The first ink in the pressure chamber Ca is ejected from the nozzle N by the drive element Ea changing the pressure of the first ink in the pressure chamber Ca.

Similarly to the first liquid ejecting portion Qa, the second liquid ejecting portion Qb includes a second liquid storage chamber Rb, a plurality of pressure chambers Cb, and a plurality of drive elements Eb. The second liquid storage chamber Rb is a common liquid chamber continuous over the plurality of nozzles N of the nozzle row Lb. The pressure chamber Cb and the drive element Eb are provided so as to respectively correspond to the nozzle N of the nozzle row Lb. Each of the plurality of pressure chambers Cb is filled with the second ink supplied from the second liquid storage chamber Rb. The drive element Eb is an energy generation element generating energy for ejecting ink by a drive signal being applied. The drive element Eb is, for example, the above-described piezoelectric element or heating element. The second ink in the pressure chamber Cb is ejected from the nozzle N by the drive element Eb changing the pressure of the second ink in the pressure chamber Cb.

Each circulation head Hn is provided with a supply hole Ra_in, a discharge hole Ra_out, a supply hole Rb_in, and a discharge hole Rb_out. The supply hole Ra_in and the discharge hole Ra_out communicate with the first liquid storage chamber Ra. In addition, the supply hole Rb_in and the discharge hole Rb_out communicate with the second liquid storage chamber Rb.

The first ink not ejected from each nozzle N of the nozzle row La circulates in the path of the discharge hole Ra_out→the first discharge flow path Da→the first sub tank 13*a*→the first supply flow path Sa→the supply hole Ra_in→the first liquid storage chamber Ra. Likewise, the second ink not ejected from each nozzle N of the nozzle row Lb circulates in the path of the discharge hole Rb_out→the second discharge flow path Db→the second sub tank 13*b*→the second supply flow path Sb→the supply hole Rb_in→the second liquid storage chamber Rb.

Although not illustrated, the circulation head Hn is configured by stacking of a plurality of substrates such as a nozzle substrate, a reservoir substrate, a pressure chamber substrate, and an element substrate. For example, the nozzle row La and the nozzle row Lb described above are provided on a nozzle substrate. The first liquid storage chamber Ra and the second liquid storage chamber Rb are provided on a reservoir substrate. The plurality of pressure chambers Ca and the plurality of pressure chambers Cb are provided on a pressure chamber substrate. The plurality of drive elements Ea and the plurality of drive elements Eb are provided on an element substrate.

1-5. Disposition of Head Unit 252

Figure 7:
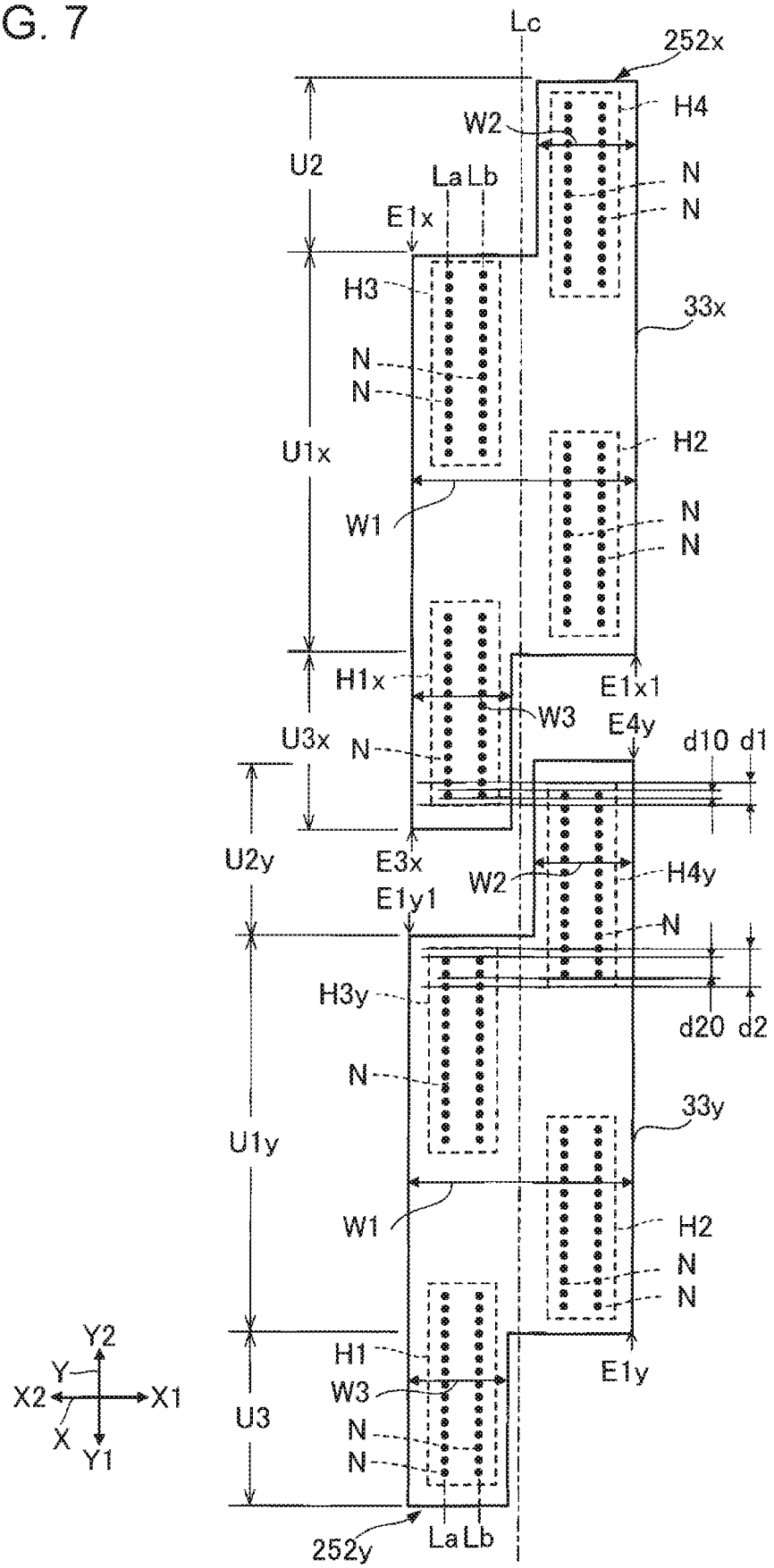
FIG. 7 is a diagram illustrating the disposition of the head unit.

FIG. 7 is a diagram illustrating the disposition of the head unit 252 and is a plan view in which the head unit 252 is viewed from the Z1 direction. FIG. 7 illustrates any two head units 252 of the head module 25 arranged along the Y1 direction. In addition, the holder 33 and the circulation head Hn are illustrated in FIG. 7.

In the following description, one and the other of the two head units 252 illustrated in FIG. 7 will be referred to as a first head unit 252*x* and a second head unit 252*y*, respectively. In addition, the circulation head H1 of the first head unit 252*x* will be referred to as a first head H1*x*. The circulation head H4 of the second head unit 252*y* will be referred to as a second head H4*y*. The circulation head H3 of the second head unit 252*y* will be referred to as a third head H3*y*. The first head H1*x* is the circulation head Hn closest to the second head unit 252*y* among the circulation heads Hn of the first head unit 252*x*. The second head H4*y* is the circulation head Hn closest to the second head unit

252y among the circulation heads Hn of the second head unit 252y. The third head H3y, which is one of the circulation heads Hn of the second head unit 252y, has a part overlapping the second head H4y in the Y1 direction.

The holder 33 of the first head unit 252x is referred to as a first holder 33x. The holder 33 of the second head unit 252y is referred to as a second holder 33y. In addition, the first head part U1 of the first head unit 252x is referred to as a first part U1x. The third head part U3 of the first head unit 252x is referred to as a second part U3x. The first head part U1 of the second head unit 252y is referred to as a third part U1y. The second head part U2 of the second head unit 252y is referred to as a fourth part U2y.

The plurality of nozzles N provided in the first head H1x correspond to a "plurality of first nozzles". The plurality of nozzles N provided in a plurality of the second heads H4y correspond to a "plurality of second nozzles". The plurality of nozzles N provided in the third head H3y correspond to a "plurality of third nozzles". In addition, the nozzle row La of the first head H1x corresponds to a "first nozzle row". The nozzle row La of the second head H4y corresponds to a "second nozzle row". The nozzle row La of the third head H3y corresponds to a "third nozzle row". It should be noted that the nozzle row Lb of the first head H1x may correspond to the "first nozzle row", the nozzle row Lb of the second head H4y may correspond to the "second nozzle row", and the nozzle row Lb of the third head H3y may correspond to the "second nozzle row". The drive element Ea of the first head H1x corresponds to a "first energy generation element". The drive element Ea of the second head H4y corresponds to a "second energy generation element". The drive element Ea of the third head H3y corresponds to a "third energy generation element". It should be noted that the drive element Eb of the first head H1x may correspond to the "first energy generation element", the drive element Eb of the second head H4y may correspond to the "second energy generation element", and the drive element Eb of the third head H3y may correspond to the "third energy generation element".

As exemplified in FIG. 7, the first head unit 252x and the second head unit 252y are arranged in the Y1 direction. A part of the second part U3x and a part of the fourth part U2y are adjacent to each other along the X axis. In other words, the first head unit 252x and the second head unit 252y are arranged in the Y1 direction such that a part of the second part U3x and a part of the fourth part U2y overlap in the Y1 direction. In addition, the center line Lc of the first head unit 252x and the center line Lc of the second head unit 252y coincide with each other and are parallel to the Y1 direction. The first head unit 252x and the second head unit 252y have the same shape and are disposed in the same orientation. It should be noted that every head unit 252 of the head module 25 is disposed such that the center line Lc is along the Y1 direction.

Each of the first head H1x, the second head H4y, and the third head H3y has a longitudinal shape when viewed from the Z1 direction and is disposed such that the longitudinal direction is along the Y1 direction. The first head H1x and the third head H3y are positioned in the X2 direction with respect to the center line Lc, and the second head H4y is positioned in the X1 direction with respect to the center line Lc. In addition, the row directions of the respective nozzle rows La of the first head H1x, the second head H4y, and the third head H3y are parallel to the Y1 direction. The row directions of the respective nozzle rows Lb of the first head H1x, the second head H4y, and the third head H3y are also parallel to the Y1 direction.

The first head H1x and the second head H4y are provided at different positions in the X1 direction and the Y1 direction. Specifically, the position of the geometric center of the first head H1x and the position of the geometric center of the second head H4y are different in both the X1 direction and the Y1 direction. In addition, the second head H4y and the third head H3y are provided at different positions in the X1 direction and the Y1 direction. Specifically, the position of the geometric center of the second head H4y and the position of the geometric center of the third head H3y are different in both the X1 direction and the Y1 direction.

As exemplified in FIG. 7, a width d1 at which the first head H1x and the second head H4y overlap in the Y1 direction is smaller than a width d2 at which the second head H4y and the third head H3y overlap in the Y1 direction. In other words, the first head unit 252x and the second head unit 252y are disposed such that the width d1 is smaller than the width d2. The width d1 is the length of the range in which the first head H1x and the second head H4y overlap in the Y1 direction. The width d2 is the length of the range in which the second head H4y and the third head H3y overlap in the Y1 direction. It should be noted that the width d1 includes 0 (zero). In other words, although the first head H1x and the second head H4y overlap in the Y1 direction in the present embodiment, the first head H1x and the second head H4y may not overlap in the Y1 direction.

A width d10 at which the nozzle row La of the first head H1x and the nozzle row La of the second head H4y overlap in the Y1 direction is smaller than a width d20 at which the nozzle row La of the second head H4y and the nozzle row La of the third head H3y overlap in the Y1 direction. In other words, the first head unit 252x and the second head unit 252y are disposed such that the width d10 is smaller than the width d20. It should be noted that the same applies to each nozzle row Lb.

In other words, as for the size relationship of the widths at which the nozzle rows overlap, the number of the nozzles N positioned at the same position on the Y axis between the first head H1x and the second head H4y is smaller than the number of the nozzles N positioned at the same position on the Y axis between the second head H4y and the third head H3y. Between the first head H1x and the second head H4y, only the nozzle N positioned in the Y-axis end portion is positioned at the same position on the Y axis. On the other hand, between the second head H4y and the third head H3y, the nozzle N positioned in the Y-axis end portion and the nozzle N closer to the middle by one than the nozzle N are positioned at the same position on the Y axis.

Each of the first head unit 252x and the second head unit 252y includes the drive portion 320 (exemplified in FIG. 4) for supplying a drive signal to the drive elements Ea and Eb. The drive portion 320 of the first head unit 252x corresponds to a "first drive portion". The drive portion 320 of the second head unit 252y corresponds to a "second drive portion". The drive portion 320 of the first head unit 252x supplies the first head H1x with a drive signal for driving the drive elements Ea and Eb of the first head H1x. The drive portion 320 of the second head unit 252y supplies the second head H4y with a drive signal for driving the drive elements Ea and Eb of the second head H4y. In addition, the drive portion 320 of the second head unit 252y supplies the third head H3y with a drive signal for driving the drive elements Ea and Eb of the third head H3y.

The reason why the first head H1x and the second head H4y are overlapped in the Y1 direction and the reason why the second head H4y and the third head H3y are overlapped in the Y1 direction will be described. A manufacturing error may result in a difference in ejection amount even when the same drive signal is supplied to each circulation head Hn. Described here for simplification is a case where each of the ejection amount from the first head H1$x$ and the ejection amount from the third head H3$y$ becomes V1 and the ejection amount from the second head H4$y$ becomes V2 (>V1) when a certain same drive signal is supplied.

Here, when a so-called solid image is recorded on the medium 11, the image concentration at a time of recording at the ejection amount V1 is D1 and the image concentration at a time of recording at the ejection amount V2 is D2 (>D1). Then, the region of the image concentration D1 and the region of the image concentration D2 are adjacent to each other in the Y direction on the medium 11 when the first head H1$x$ and the second head H4$y$ are not overlapped in the Y1 direction. Then, a sharp change of concentration difference D2−D1 occurs along the Y axis, and thus a significant decline in image quality arises.

On the other hand, a case is conceivable where the first head H1$x$ and the second head H4$y$ are overlapped in the Y1 direction and a solid image is recorded with the first head H1$x$ and the second head H4$y$ bearing 50% each at the overlapped part. In this case, the image concentration of the region on the medium 11 recorded in a divided manner becomes (D1+D2)/2. Accordingly, a region having an image concentration of (D1+D2)/2 is formed between the region of the image concentration D1 and the region of the image concentration D2. Then, a concentration difference of (D1−D2)/2 occurs between the region of the image concentration D1 and the image concentration (D1+D2)/2 and a concentration difference of (D2−D1)/2 occurs between the image concentration (D1+D2)/2 and the region of the image concentration D2.

In other words, the concentration change along the Y axis can be made stepwise and each concentration difference can be reduced as compared with a case where the region of image concentration (D1+D2)/2 is not formed. In other words, the concentration change along the Y axis can be moderated. As a result, a decline in image quality can be suppressed. The decline in image quality at this time can be more suppressed as the Y-axis length of the region of image concentration (D1+D2)/2, that is, the region where the first head H1$x$ and the second head H4$y$ are overlapped increases. The region of image concentration (D1+D2)/2 becoming longer on the Y axis is because the concentration change along the Y axis becomes more moderate.

Next, the reason why the width d2 at which the second head H4$y$ and the third head H3$y$ are overlapped in the Y1 direction is increased will be described. In the present embodiment, the second head H4$y$ and the third head H3$y$ of the second head unit 252$y$ are driven in common by the drive portion 320 provided in the second head unit 252$y$. Accordingly, the same drive signal is applied to the second head H4$y$ and the third head H3$y$ of the second head unit 252$y$.

As described above, the ejection amount from the second head H4$y$ is V2 and the ejection amount from the third head H3$y$ is V1. Since the same drive signal is applied to the second head H4$y$ and the third head H3$y$, these ejection amounts V1 and V2 cannot be individually changed. In other words, it is impossible to change the ejection amount from the third head H3$y$ from V1 toward V2 with the ejection amount from the second head H4$y$ at V2 by, for example, reducing the energy amount of the drive signal applied to the third head H3$y$.

Accordingly, a significant decline in image quality may arise from the above-described concentration difference along the Y axis, and thus the width d2 at which the second head H4$y$ and the third head H3$y$ are overlapped in the Y1 direction is increased, the concentration change along the Y axis is moderated as much as possible, and a decline in image quality is reduced.

It should be noted that a similar problem arises between two circulation heads Hn of the same head unit adjacent to each other on the Y axis in the present embodiment and thus the amount by which the circulation heads Hn are overlapped on the Y axis is a large value of d2 although the second head H4$y$ and the third head H3$y$ have been described here.

On the other hand, the reason why the width d1 at which the first head H1$x$ and the second head H4$y$ are overlapped in the Y1 direction is reduced will be described. In the present embodiment, the first head H1$x$ of the first head unit 252$x$ is driven by the drive portion 320 provided in the first head unit 252$x$. On the other hand, the second head H4$y$ of the second head unit 252$y$ is driven by the drive portion 320 provided in the second head unit 252$y$. In other words, the first head H1$x$ of the first head unit 252$x$ and the second head H4$y$ of the second head unit 252$y$ are individually driven, and thus different drive signals can be applied.

When a certain same drive signal is supplied as described above, the ejection amount from the first head H1$x$ is V1 and the ejection amount from the second head H4$y$ is V2. However, since different drive signals can be supplied to the first head H1$x$ and the second head H4$y$, the energy amount of the drive signal applied to the first head H1$x$ can be made larger than, for example, the energy amount of the drive signal applied to the second head H4$y$. In other words, it is possible to change the ejection amount from the first head H1$x$ from V1 toward V2 with the ejection amount from the second head H4$y$ at V2.

As a result, it is possible to reduce the concentration difference between the first head H1$x$ and the second head H4$y$ itself, and thus a decline in image quality resulting from the above-described concentration difference along the Y axis can be reduced by a drive signal. Accordingly, it is possible to make a decline in image quality resulting from the concentration difference less noticeable even when the width d1 at which the first head H1$x$ and the second head H4$y$ are overlapped in the Y1 direction is small.

It should be noted that a similar problem arises between two circulation heads Hn of different head units adjacent to each other on the Y axis in the present embodiment and thus the amount by which the circulation heads Hn are overlapped on the Y axis is a small value of d1 although the first head H1$x$ and the second head H4$y$ have been described here.

It should be noted that the first head H1$x$ and the second head H4$y$ being overlapped in the Y1 direction at a large width poses no particular problem insofar as only a decline in image quality resulting from the concentration difference is taken into consideration. Although it is possible to suppress a decline in image quality resulting from the concentration difference by supplying different drive signals as described above, an increase in the width of overlapping only further suppresses the decline in image quality.

However, an unnecessary increase in the width at which the first head H1$x$ and the second head H4$y$ are overlapped in the Y1 direction leads to a decrease in the recording width of the head module 25 in one scan. When the recording width in one scan decreases, the number of scans required for recording of the entire region on the medium 11 increases, and thus the time (throughput) required for image recording in the entire region increases. Accordingly, it is necessary to reduce the width at which the first head H1$x$ and the second head H4*y* are overlapped in the Y1 direction in order to suppress both a decline in image quality resulting from the concentration difference and the throughput extension.

In addition, the plurality of nozzles N of the nozzle row La provided in the first head H1*x*, the plurality of nozzles N of the nozzle row La provided in the second head H4*y*, and the nozzle N of the nozzle row La provided in the third head H3*y* eject ink of the same color. Also, as for the nozzle row Lb, ink of the same color is ejected by the first head H1*x*, the second head H4*y*, and the third head H3*y*. It is possible to particularly effectively suppress a decline in image quality resulting from the concentration difference by the nozzle rows La that eject ink of the same color overlapping in part in the Y1 direction.

As exemplified in FIG. 7, the first head unit 252*x* and the second head unit 252*y* are disposed such that the first head H1*x* and the second head H4*y* are at different positions in the X1 direction. Since the first head H1*x* and the second head H4*y* are provided at different positions in the X1 direction, a part of the first head H1*x* and a part of the second head H4*y* can be disposed so as to overlap in the Y1 direction. Accordingly, it is possible to suppress a decline in image quality resulting from the concentration difference between the first head unit 252*x* and the second head unit 252*y* as compared with a case where the first head H1*x* and the second head H4*y* do not overlap in the Y1 direction.

In addition, the first head H1*x* is disposed in the first holder 33*x*. The second head H4*y* and the third head H3*y* are disposed in the second holder 33*y*. The second head H4*y* and the third head H3*y* are integrated by the second holder 33*y*. The first head H1*x*, the second head H4*y*, and the third head H3*y* are easily disposed such that the width d1 is smaller than the width d2 by the first holder 33*x* and the second holder 33*y* being aligned. Further, in the present embodiment, the first holder 33*x* and the second holder 33*y* have the same shape. Accordingly, it is possible to align the first holder 33*x* and the second holder 33*y* with ease and high precision as compared with a case where the first holder 33*x* and the second holder 33*y* do not have the same shape.

In the present embodiment, the circulation heads H2, H3, and H4 as well as the first head H1*x* are disposed in the first holder 33*x*. In addition, the circulation heads H1 and H2 as well as the second head H4*y* and the third head H3*y* are disposed in the second holder 33*y*. The plurality of circulation heads Hn can be integrated by the holder 33 by the plurality of circulation heads Hn being disposed in the holder 33.

As exemplified in FIG. 7, the first head unit 252*x* has the first part U1*x* and the second part U3*x*. The second head unit 252*y* has the third part U1*y* and the fourth part U2*y*. In addition, some of the plurality of nozzles N provided in the first head H1*x* are provided at each of the first part U1*x* and the second part U3*x*. Some of the plurality of nozzles N provided in the second head H4*y* are provided at each of the third part U1*y* and the fourth part U2*y*. In addition, the width W3 of the second part U3*x* is shorter than the width W1 of the first part U1*x*. The width W2 of the fourth part U2*y* is shorter than the width W1 of the third part U1*y*. By providing the second part U3*x* and the fourth part U2*y*, it is possible to further reduce the installation space of the first head unit 252*x* and the second head unit 252*y* in the X1 direction as compared with a case where each of the first head unit 252*x* and the second head unit 252*y* has a rectangular shape having the width W1.

The second part U3*x* is coupled to the first part U1*x* in the Y1 direction with respect to the first part U1*x*. In other words, the first part U1*x* and the second part U3*x* are disposed along the Y1 direction and the first part U1*x* and the second part U3*x* are continuous. Further, the second part U3*x* is positioned between the first part U1*x* and the third part U1*y*. In addition, the fourth part U2*y* is coupled to the fourth part U2*y* in the Y2 direction with respect to the third part U1*y*. In other words, the third part U1*y* and the fourth part U2*y* are disposed along the Y2 direction and the third part U1*y* and the fourth part U2*y* are continuous. Further, the fourth part U2*y* is positioned between the third part U1*y* and the first part U1*x*. Since the first part U1*x*, the second part U3*x*, the fourth part U2*y*, and the third part U1*y* are disposed as described above, it is possible to further reduce the installation space of the first head unit 252*x* and the second head unit 252*y* in the X1 direction as described above.

The first head unit 252*x* and the second head unit 252*y* are disposed such that a part of the second part U3*x* and a part of the fourth part U2*y* overlap in the Y1 direction. In other words, a part of the first head H1*x* and a part of the second head H4*y* are adjacent to each other along the X axis. Accordingly, the plurality of head units 252 can be disposed such that the width d1 is smaller than the width d2 in a space-saving manner.

In addition, a part of the first head H1*x* is positioned at the second part U3*x* and the other part of the first head H1*x* is positioned at the first part U1*x*. In addition, a part of the second head H4*y* is positioned at the fourth part U2*y* and the other part of the second head H4*y* is positioned at the third part U1*y*. Further, the third head H3*y* is positioned at the third part U1*y*. In addition, as described above, a part of the first head H1*x* and a part of the second head H4*y* overlap in the X1 direction and the other part of the second head H4*y* and a part of the third head H3*y* overlap in the X1 direction. Accordingly, the first head unit 252*x* and the second head unit 252*y* can be disposed such that the width d1 is smaller than the width d2 in a space-saving manner.

As exemplified in FIG. 7, an end surface E3*x* on the third side of the second part U3*x* and an end surface E1*x* on the third side of the first part U1*x* are positioned at the same position in the X1 direction. The end surface E3*x* and the end surface E1*x* form a continuous flat surface. The end surface E3*x* and the end surface E1*x* form a straight line shape when viewed from the Z1 direction. In addition, an end surface E4*y* on the fourth side of the fourth part U2*y* and an end surface Ely on the fourth side of the third part U1*y* are positioned at the same position in the X1 direction. The end surface E4*y* and the end surface Ely form a continuous flat surface. The end surface E4*y* and the end surface Ely form a straight line shape when viewed from the Z1 direction. Since the end surface E3*x* and the end surface E1*x* constitute the flat surface and the end surface E4*y* and the end surface Ely constitute the flat surface, the first head unit 252*x* and the second head unit 252*y* can be more closely disposed in the X1 direction as compared with a case where a step is provided between the end surface E3*x* and the end surface E1*x* or a step is provided between the end surface E4*y* and the end surface Ely.

In the present embodiment, the respective surfaces of the cover 38, the flow path member 31, and the holder 33 that are along the Y-Z plane corresponding to the end surface E3*x* and the end surface E1*x* have a straight line shape along the center line Lc when viewed from the Z1 direction. In addition, the respective surfaces of the cover 38, the flow path member 31, and the holder 33 that are along the Y-Z plane corresponding to the end surface E4*y* and the end surface Ely have a straight line shape along the center line Lc when viewed from the Z1 direction.

The end surface E3*x* on the third side of the second part U3*x*, the end surface E1*x* on the third side of the first part U1*x*, and an end surface E1*y*1 on the third side of the third part U1*y* are positioned at the same position in the X1 direction. The end surface E4*y* on the fourth side of the fourth part U2*y* and the end surface Ely on the fourth side of the third part U1*y* are positioned at the same position in the X1 direction as an end surface E1*x*1 on the fourth side of the first part U1*x*. From another perspective, the first head unit 252*x* and the second head unit 252*y* have the same shape and are disposed in the same orientation such that the center lines Lc of the first head unit 252*x* and the second head unit 252*y* coincide with each other. With this disposition, the first head unit 252*x* and the second head unit 252*y* can be more closely disposed in the X1 direction such that the width d1 is smaller than the width d2 in a space-saving manner.

It should be noted that it is possible to increase the Y-axis distance between the first head unit 252*x* and the second head unit 252*y* in the present embodiment so that the width at which the first head H1*x* and the second head H4*y* overlap on the Y axis is reduced. Accordingly, it is possible to increase the Y-axis length of the beam portion of the support body 251 that is between the first head unit 252*x* and the second head unit 252*y* on the Y axis, and thus the rigidity of the beam portion of the support body 251 can also be enhanced.

2. Second Embodiment

A second embodiment will be described. It should be noted that elements in each of the following exemplifications that are similar in function to those of the first embodiment will be denoted by the reference numerals used in the description of the first embodiment and detailed description of the elements will be appropriately omitted.

Figure 8:
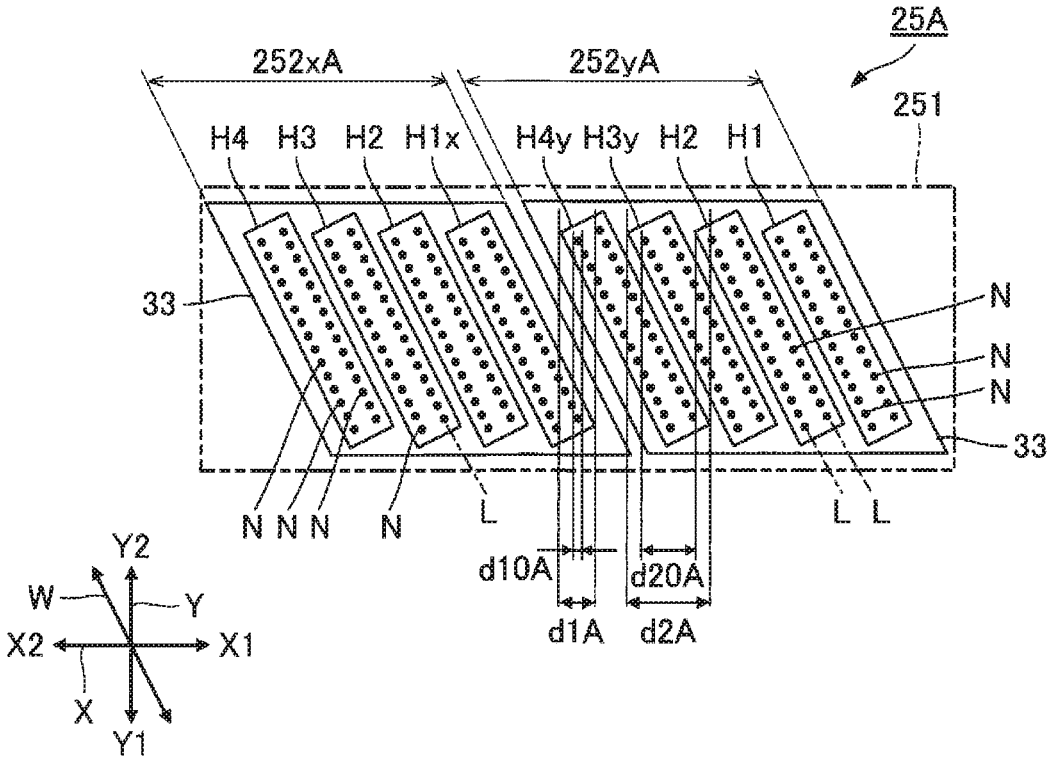
FIG. 8 is a plan view of a head module in a second embodiment.

FIG. 8 is a plan view of a head module 25A in the second embodiment. As exemplified in FIG. 8, each of a first head unit 252*x*A and a second head unit 252*y*A of the head module 25A has the plurality of circulation heads Hn arranged along the X axis. For example, the circulation heads Hn eject ink of different colors. It should be noted that the number of the circulation heads Hn is any number. In addition, a plurality of the first head units 252*x*A and a plurality of the second head units 252*y*A may be provided. For example, a long line head is configured by the plurality of first head units 252*x*A and the plurality of second head units 252*y*A being arranged along the X axis. It should be noted that drive signals are supplied from separate drive portions 320 to the first head unit 252*x*A and the second head unit 252*y*A.

The plurality of nozzles N of the circulation head Hn are arranged along a W axis. In addition, a plurality of nozzle rows L are parallel to the W axis and are arranged in parallel at intervals in a direction orthogonal to the W axis. The W axis is inclined at a predetermined angle with respect to the X axis or the Y axis in the X-Y plane. For example, the W axis forms an angle of 10° or more and 80° or less with respect to the Y axis. By the plurality of nozzles N being arranged along the W axis, the substantial dot density in a direction along the Y axis can be enhanced as compared with a case where the plurality of nozzles N are arranged along the Y axis.

As exemplified in FIG. 8, the second head H4*y* and the third head H3*y* are provided at different positions in the X1 direction. A width d1A at which the first head H1*x* and the second head H4*y* overlap in the Y1 direction is smaller than a width d2A at which the second head H4*y* and the third head H3*y* overlap in the Y1 direction. In other words, the first head unit 252*x*A and the second head unit 252*y*A are disposed such that the width d1A is smaller than the width d2A.

In other words, a width d10A at which the nozzle row L of the first head H1*x* and the nozzle row L of the second head H4*y* overlap in the X1 direction is smaller than a width d20A at which the nozzle row L of the second head H4*y* and the nozzle row L of the third head H3*y* overlap in the X1 direction. In other words, the first head unit 252*x* and the second head unit 252*y* are disposed such that the width d10A is smaller than the width d20A.

With the second embodiment as well as the first embodiment, it is possible to suppress both a decline in image quality resulting from the concentration difference and the throughput extension.

3. Modification Example

The embodiments exemplified above can be variously modified. Specific modification aspects that can be applied to the above-described embodiments will be exemplified below. Any two or more aspects selected from the following exemplifications can be appropriately merged within a range of mutual non-contradiction.

1. The number of the circulation heads Hn provided in one head unit 252 may be three or less or five or more although the number of the circulation heads Hn provided in one head unit 252 is four in each of the embodiments described above.

Figure 9:
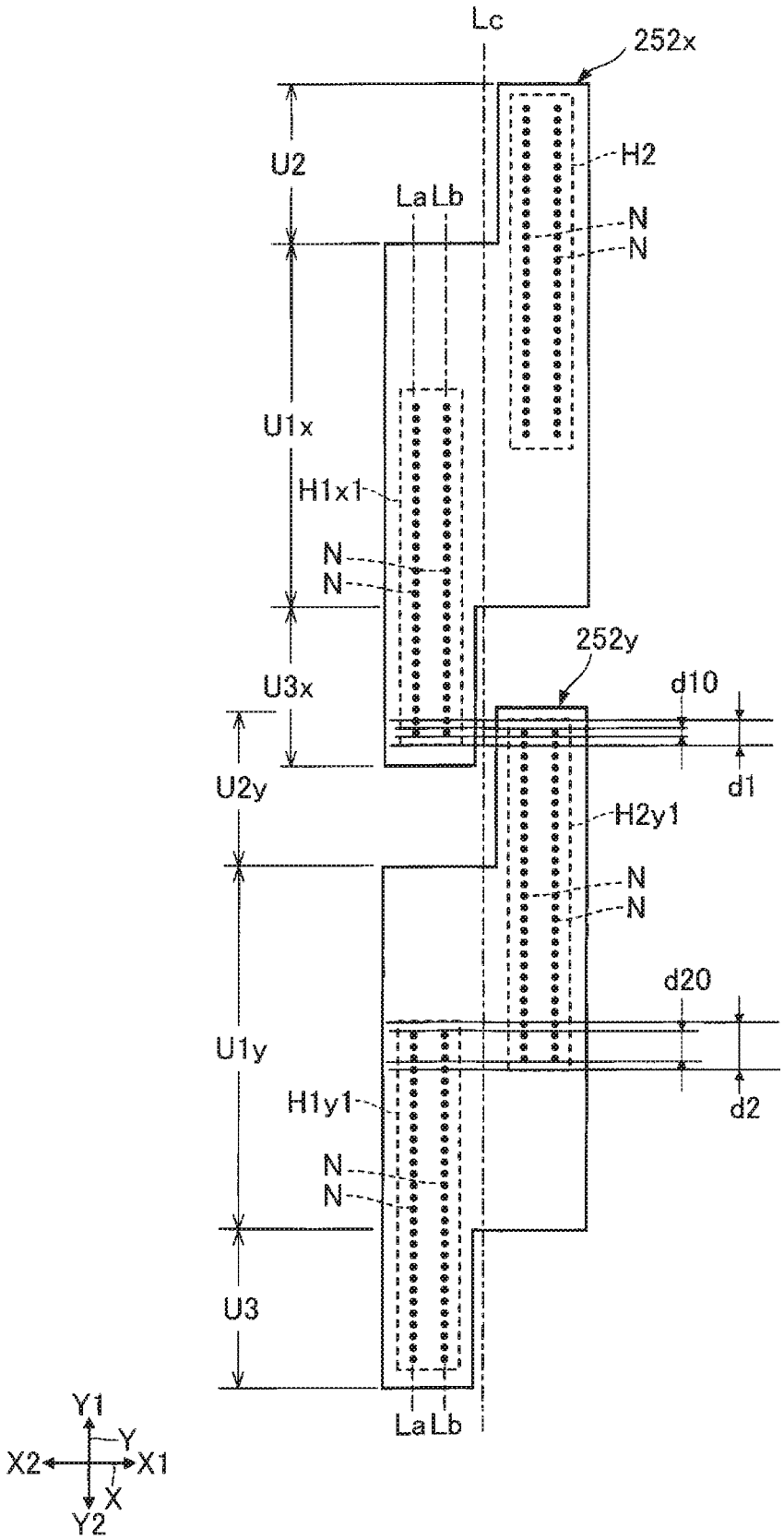
FIG. 9 is a plan view illustrating a first head unit and a second head unit in a modification example.

FIG. 9 is a plan view illustrating the first head unit 252*x* and the second head unit 252*y* in a modification example. Each of the first head unit 252*x* and the second head unit 252*y* exemplified in FIG. 9 has the circulation heads H1 and H2. In the example of FIG. 9, the circulation head H1 of the first head unit 252*x* is referred to as a first head H1*x*1. The circulation head H2 of the second head unit 252*y* is referred to as a second head H2*y*1. The circulation head H1 of the second head unit 252*y* is referred to as a third head H1*y*1.

As in the first embodiment, in the modification example illustrated in FIG. 9, the first head unit 252*x* and the second head unit 252*y* are disposed such that the width d1 at which the first head H1*x*1 and the second head H2*y*1 overlap in the Y1 direction is smaller than the width d2 at which second head H2*y*1 and the third head H1*y*1 overlap in the Y1 direction. In addition, the first head unit 252*x* and the second head unit 252*y* are disposed such that the width d10 at which the nozzle row La of the first head H1*x*1 and the nozzle row La of the second head H2*y*1 overlap in the Y1 direction is smaller than the width d20 at which the nozzle row La of the second head H2*y*1 and the nozzle row La of the third head H1*y*1 overlap in the Y1 direction. With the modification example as well as the first embodiment described above, it is possible to suppress both a decline in image quality resulting from the concentration difference and the throughput extension.

2. Although the second head part U2 and the third head part U3 in each head unit 252 are positioned on the opposite sides of the X axis across the center line Lc in the first embodiment described above, the disposition of the second head part U2 and the third head part U3 is not limited thereto.

Figure 10:
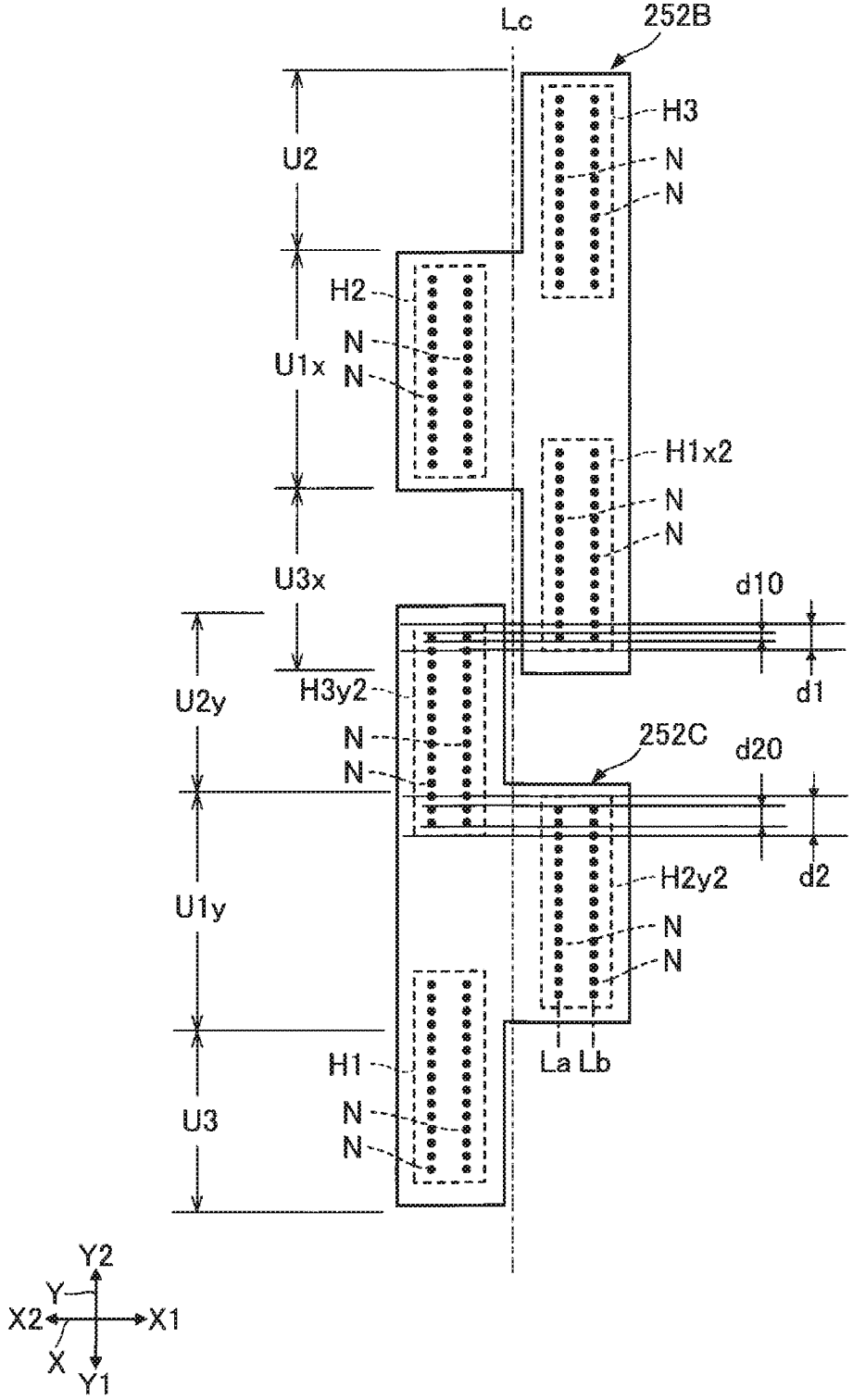
FIG. 10 is a plan view illustrating a first head unit and a second head unit in a modification example.

FIG. 10 is a plan view illustrating a first head unit 252B and a second head unit 252C in a modification example. As exemplified in FIG. 10, the first head unit 252B and the second head unit 252C are configured to be plane-symmetrical to each other in the Y-Z plane. In the first head unit 252B, the second head part U2 and the second part U3*x* are positioned in the X1 direction with respect to the center line Lc. In other words, in the first head unit 252B, the second head part U2 and the third head part U3 are positioned on the same side with respect to the center line Lc. In addition, in the second head unit 252C, the fourth part U2*y* and the third head part U3 are positioned in the X2 direction with respect to the center line Lc. In other words, in the second head unit 252C, the second head part U2 and the third head part U3 are positioned on the same side with respect to the center line Lc.

Each of the first head unit 252*x* and the second head unit 252*y* exemplified in FIG. 10 has the circulation heads H1, H2, and H3. In the example of FIG. 10, the circulation head H1 of the first head unit 252*x* is referred to as a first head H1*x*2. The circulation head H3 of the second head unit 252*y* is referred to as a second head H3*y*2. The circulation head H2 of the second head unit 252*y* is referred to as a third head H2*y*2. The width d1 at which the first head H1*x*2 and the second head H3*y*2 overlap in the Y1 direction is smaller than the width d2 at which the second head H3*y*2 and the third head H2*y*2 overlap in the Y1 direction. In addition, the width d10 at which the nozzle row La of the first head H1*x*2 and the nozzle row La of the second head H3*y*2 overlap in the Y1 direction is smaller than the width d20 at which the nozzle row La of the second head H3*y*2 and the nozzle row La of the third head H2*y*2 overlap in the Y1 direction. It should be noted that the same applies to each nozzle row Lb. With the modification example as well as the first embodiment described above, it is possible to suppress both a decline in image quality resulting from the concentration difference and the throughput extension.

3. In each of the embodiments described above, a case where the circulation head Hn is configured by stacking of a plurality of substrates such as a nozzle substrate, a reservoir substrate, a pressure chamber substrate, and an element substrate has been described as an example. However, one or more of the nozzle substrate, the reservoir substrate, the pressure chamber substrate, and the element substrate may be individually provided for each circulation head Hn and another substrate may be common to the plurality of circulation heads Hn in the head unit 252. For example, one or more of the reservoir substrate, the pressure chamber substrate, and the element substrate may be provided so as to be common to the plurality of circulation heads Hn in the head unit 252 when the nozzle substrate is individually provided for each circulation head Hn. In addition, the nozzle substrate or the like may be provided so as to be common to the plurality of circulation heads Hn in the head unit 252 when the reservoir substrate and the pressure chamber substrate are individually provided for each circulation head Hn.

4. Although the sub tank 13 is provided outside the head unit 252 and ink is circulated between the head unit 252 and the sub tank 13 in each of the embodiments described above, ink may be circulated between the outside of the head unit 252 and a system other than the sub tank 13. For example, ink may be circulated between the head unit 252 and the liquid container 12.

5. Although the head unit 252 has the first discharge flow path Da, the second discharge flow path Db, the first discharge protruding portion 313*a*, and the second discharge protruding portion 313*b* in each of the embodiments described above, the head unit 252 may not have the first discharge flow path Da, the second discharge flow path Db, the first discharge protruding portion 313*a*, and the second discharge protruding portion 313*b*. In other words, the head unit 252 may have no liquid circulation mechanism.

6. Although different types of ink are supplied to the first supply flow path Sa and the second supply flow path Sb in each of the embodiments described above, the same type of ink may be supplied to the first supply flow path Sa and the second supply flow path Sb.

7. Although the drive portion 320 is provided on the wiring substrate 32 in each of the embodiments described above, the drive portion 320 may be provided at a location other than the wiring substrate 32. For example, the drive portion 320 may be provided on the side surface of the flow path member 31. In addition, although one drive portion 320 is provided for each head unit 252 in each of the embodiments described above, each embodiment is not limited to this system. For example, two drive portions 320 may be provided for each head unit 252, one of the drive portions 320 may supply a drive signal to the drive element of the circulation head H1 and the circulation head H2, and the other drive portion 320 may supply a drive signal to the drive element of the circulation head H3 and the circulation head H4.

8. Although each holder 33 is provided with the plurality of circulation heads Hn in each of the embodiments described above, at least the first head H1*x* may be disposed in the first holder 33*x* and at least the second head H4*y* and the third head H3*y* may be disposed in the second holder 33*y*.

9. Although the "first direction" and the "second direction" are orthogonal to each other in each of the embodiments described above, the first and second directions may intersect with each other without being orthogonal to each other.

10. Although the first nozzle of the first head H1*x* and the second nozzle of the second head H4*y* are arranged along the X axis in the first embodiment described above, the first and second nozzles may not be arranged along the X axis. In other words, the first and second nozzles may be misaligned in the Y1 direction. Likewise, the second and third nozzles may be misaligned in the Y1 direction.

11. Although the direction in which the medium 11 is transported and the direction in which the first head unit 252*x* and the second head unit 252*y* are arranged are the same in the first embodiment described above, the directions may be different from each other. For example, the direction in which the medium 11 is transported may be orthogonal to the direction in which the first head unit 252*x* and the second head unit 252*y* are arranged.

12. Although the first head unit 252*x* and the second head unit 252*y* have the same shape in the first embodiment described above, the first head unit 252*x* and the second head unit 252*y* may differ from each other.

13. Although a serial-type liquid ejecting apparatus causing the transport body 241 equipped with the head unit 252 to reciprocate has been exemplified in each of the embodiments described above, the present disclosure is also applicable to a line-type liquid ejecting apparatus in which the plurality of nozzles N are distributed over the entire width of the medium 11.

14. The liquid ejecting apparatus exemplified in each of the embodiments described above can be applied to various types of equipment such as a facsimile apparatus and a photocopier as well as dedicated printing equipment. However, the applications of the liquid ejecting apparatus are not limited to printing. For example, a liquid ejecting apparatus that ejects a solution of a color material is used as a manufacturing apparatus forming a color filter of a display device such as a liquid crystal display panel. In addition, a liquid ejecting apparatus that ejects a solution of a conductive material is used as a manufacturing apparatus forming an electrode or wiring of a wiring substrate. In addition, a liquid ejecting apparatus that ejects a solution of a living body-related organic substance is used as, for example, a biochip manufacturing apparatus.

What is claimed is:

1. A liquid ejecting apparatus ejecting a liquid, the liquid ejecting apparatus comprising:

a first head unit having a first head provided with a plurality of first nozzles; and a second head unit having a second head provided with a plurality of second nozzles and a third head provided at a position different from the second head in a first direction and provided with a plurality of third nozzles, wherein the second head and the third head are provided at different positions in a second direction intersecting with the first direction, the first head unit has a first part provided with some of the plurality of first nozzles and a second part provided with some of the plurality of first nozzles and shorter in width than the first part in the second direction, the second head unit has a third part provided with some of the plurality of second nozzles and a fourth part provided with some of the plurality of second nozzles and shorter in width than the third part in the second direction, and the first head unit and the second head unit are disposed such that a width at which the first head and the second head overlap in the first direction is smaller than a width at which the second head and the third head overlap in the first direction.

2. The liquid ejecting apparatus according to claim 1, wherein the first head unit and the second head unit are disposed such that the first head and the second head are at different positions in the second direction.

3. The liquid ejecting apparatus according to claim 1, wherein the first head unit has a first holder in which the first head is disposed, and the second head unit has a second holder in which the second head and the third head are disposed and which is different from the first holder.

4. The liquid ejecting apparatus according to claim 1, wherein the second part is coupled to the first part on a first side in the first direction with respect to the first part, and the fourth part is coupled to the third part on a second side opposite to the first side in the first direction with respect to the third part.

5. The liquid ejecting apparatus according to claim 4, wherein the first head unit and the second head unit are disposed such that a part of the second part and a part of the fourth part overlap in the first direction.

6. The liquid ejecting apparatus according to claim 1, wherein an end surface of the second part on a third side in the second direction and an end surface of the first part on the third side in the second direction are positioned at the same position in the second direction, and an end surface of the fourth part on a fourth side opposite to the third side in the second direction and an end surface of the third part on the fourth side in the second direction are positioned at the same position in the second direction.

7. The liquid ejecting apparatus according to claim 6, wherein the end surface of the second part on the third side in the second direction, the end surface of the first part on the third side in the second direction, and an end surface of the third part on the third side in the second direction are positioned at the same position in the second direction, and the end surface of the fourth part on the fourth side in the second direction, the end surface of the third part on the fourth side in the second direction, and an end surface of the first part on the fourth side in the second direction are positioned at the same position in the second direction.

8. The liquid ejecting apparatus according to claim 1, wherein a part of the first head is positioned at the second part, the other part of the first head is positioned at the first part, a part of the second head is positioned at the fourth part, the other part of the second head is positioned at the third part, and the third head is positioned at the third part.

9. The liquid ejecting apparatus according to claim 1, wherein the plurality of first nozzles, the plurality of second nozzles, and the plurality of third nozzles eject ink of the same color.

10. A liquid ejecting apparatus ejecting a liquid, the liquid ejecting apparatus comprising:

a first head unit having a first head provided with a plurality of first nozzles; and a second head unit having a second head provided with a plurality of second nozzles and a third head provided at a position different from the second head in a first direction and provided with a plurality of third nozzles, wherein the second head and the third head are provided at different positions in a second direction intersecting with the first direction, the first head unit and the second head unit are disposed such that a width at which a first nozzle row having the plurality of first nozzles and a second nozzle row having the plurality of second nozzles overlap in the first direction is smaller than a width at which the second nozzle row and a third nozzle row having the plurality of third nozzles overlap in the first direction, and the first head unit and the second head unit are disposed such that a width at which the first head and the second head overlap in the first direction is smaller than a width at which the second head and the third head overlap in the first direction.

11. The liquid ejecting apparatus according to claim 10, wherein the first head unit and the second head unit are disposed such that the first head and the second head are at different positions in the second direction.

12. The liquid ejecting apparatus according to claim 10, wherein the first head unit has a first holder in which the first head is disposed, and the second head unit has a second holder in which the second head and the third head are disposed and which is different from the first holder.

13. The liquid ejecting apparatus according to claim 10, wherein the plurality of first nozzles, the plurality of second nozzles, and the plurality of third nozzles eject ink of the same color.

14. A liquid ejecting apparatus ejecting a liquid, the liquid ejecting apparatus comprising:

a first head unit having a first head provided with a plurality of first nozzles; and a second head unit having a second head provided with a plurality of second nozzles and a third head provided at a position different from the second head in a first direction and provided with a plurality of third nozzles, wherein the second head and the third head are provided at different positions in a second direction intersecting with the first direction, the first head unit further has a first drive portion for driving a first energy generation element provided so as to correspond to the plurality of first nozzles, and the second head unit further has a second drive portion for driving a second energy generation element provided so as to correspond to the plurality of second nozzles and a third energy generation element provided so as to correspond to the plurality of third nozzles and the second drive portion is different from the first drive portion, and the first head unit and the second head unit are disposed such that a width at which the first head and the second head overlap in the first direction is smaller than a width at which the second head and the third head overlap in the first direction.

15. The liquid ejecting apparatus according to claim 14, wherein the first head unit and the second head unit are disposed such that the first head and the second head are at different positions in the second direction.

16. The liquid ejecting apparatus according to claim 14, wherein the first head unit has a first holder in which the first head is disposed, and the second head unit has a second holder in which the second head and the third head are disposed and which is different from the first holder.

17. The liquid ejecting apparatus according to claim 14, wherein the first head unit has a first holder in which the first head is disposed, and the second head unit has a second holder in which the second head and the third head are disposed and which is different from the first holder.

* * * * *